United States Patent [19]

Matsui et al.

[11] Patent Number: 4,489,967

[45] Date of Patent: Dec. 25, 1984

[54] STRUCTURE FOR REMOVABLY MOUNTING SUPPORT ROD FOR OPENABLE CLOSURE MEMBER OF MOTOR VEHICLE

[75] Inventors: Tatsuhiko Matsui, Zama; Hiroyuki Aida, Hatano; Tomoyoshi Ohnuki, Yokohama, all of Japan

[73] Assignees: Nissan Motor Company, Limited; Kato Hatsujo Kaisha, Limited, both of Yokohama, Japan

[21] Appl. No.: 539,301

[22] Filed: Oct. 5, 1983

[30] Foreign Application Priority Data

Oct. 6, 1982 [JP] Japan ..... 57-175946

[51] Int. Cl.[3] ..... E05C 17/12

[52] U.S. Cl. ..... 292/339; 292/DIG. 14

[58] Field of Search ..... 292/338, 339, 262, 107, 292/275, 80, 87, 89, 19, 271, 347, 336.3

[56] References Cited

U.S. PATENT DOCUMENTS

| | | | |
|---|---|---|---|
| 1,358,349 | 11/1920 | Waters | 292/262 X |
| 1,613,285 | 1/1927 | Moore | 292/262 |
| 2,704,220 | 3/1955 | Graham | 292/338 |
| 2,779,619 | 1/1957 | Taylor | 292/347 |

*Primary Examiner*—Richard E. Moore

*Attorney, Agent, or Firm*—Schwartz, Jeffery, Schwaab, Mack, Blumenthal & Koch

[57] ABSTRACT

In a structure for removably mounting a support rod for supporting an openable closure member such as engine hood of a motor vehicle, a retainer means formed of a plastic material is provided which is attached to at least one end of the support rod. When it is attempted to support the closure member at its open position by means of the support rod, the retainer means is fitted in a mounting aperture formed in the motor vehicle.

4 Claims, 11 Drawing Figures

STRUCTURE FOR REMOVABLY MOUNTING SUPPORT ROD FOR OPENABLE CLOSURE MEMBER OF MOTOR VEHICLE

BACKGROUND OF THE INVENTION

1. Field of the Invention

This invention relates to a structure for removably mounting a support rod for supporting, in an open position, an openable closure member such as engine hood of a motor vehicle.

2. Description of the Prior Art

In order to have a better understanding of the present invention, reference will first be made to FIGS. 1A and 1B of the accompanying drawings, which illustrate an example of the prior-art structure using a support rod 1 such as shown in FIG. 1A. The conventional support rod 1 is constituted by a rod-like metal body having the opposite ends thereof worked to be bent in a hook-like shape and in a crank-like shape as indicated at 1*a* and 1*b* respectively. As shown in FIG. 1B, the conventional support rod 1, when used, has the opposite ends 1*a* and 1*b* thereof engaged directly with a mounting aperture formed in a reinforcement panel 3 secured to the inside surface of a hood panel 2 and with another mounting aperture formed in a body panel 4 of the motor vehicle, thus supporting the hood at its open position as desired.

However, the aforementioned conventional structure is disadvantageous in that it is required that the end portion 1*a* of the support rod 1 be worked to be bent in a complicated hook-like shape with a high accuracy to prevent the support rod 1 from being removed from the hood when the latter is blown by a gust. Moreover, in the foregoing prior-art structure, the hook-like end portion 1*a* of the conventional support rod 1 formed of metal is engaged directly with the mounting aperture formed in the panel 3 as mentioned above, and thus due to the complicated hook-like configuration of the end portion 1*a*, difficulties are experienced in an attempt to mount the support rod in place. Another important disadvantage is that there has frequently occurred such a situation that scars are made on the panel surface by the end portion 1*a* of the support rod 1 when the latter is mounted in place, thus causing rust.

SUMMARY OF THE INVENTION

It is an object of the present invention to provide a novel and improved structure for removably mounting a support rod for an openable closure member such as engine hood of a motor vehicle, thereby eliminating the aforementioned disadvantages of the prior art.

Briefly stated, according to the present invention, a retainer member is provided at one or both of the ends of a support rod, the retainer member being formed of a plastic material comprising a resiliently deformable arm provided with an engagement nail, and a support means for bearing the weight of an openable closure member when the latter is supported, at its open position, by means of the support rod. The deformable arm of the retainer member is adapted, when deformed, to be inserted in a mounting aperture formed either in the closure member or the body of the motor vehicle, so that the corresponding end portion of the support rod is retained at the mounting aperture by means of the engagement nail.

Other objects, features and advantages of the present invention will become apparent from the ensuing description taken in conjunction with the accompanying drawings.

BRIEF DESCRIPTION OF THE DESCRIPTION

DESCRIPTION OF THE PREFERRED EMBODIMENTS

Figure 1A:
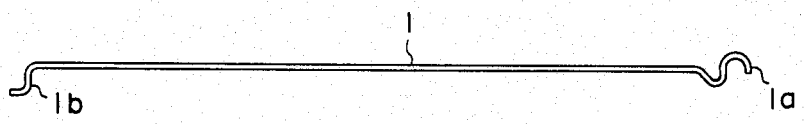
FIG. 1A PRIOR ART
FIG. 1A is a plan view showing the entire configuration of a conventional support rod formed of metal.

Referring to FIGS. 2A, 2B, 3A and 3B, there is shown the structure according to an embodiment of the present invention which includes a retainer member 11 of a plastic material configured in an inverted U-shape comprising a pair of arms 11*a* and 11*b*. The arm 11*a* is formed with an axial hole 12 which is adapted such that an end of a support rod 10, which may be constituted by a substantially straight rod-like body of a plastic material, a glass fiber-reinforced plastic material or the like, can be inserted therein so that the retainer member 11 is fixedly attached to the support rod 10 to be integral therewith. The arm 11*a* is also provided, on the outer circumferential surface thereof, with a nail or protrusion 13 which is adapted to be engaged with the outside surface of a reinforcement panel 3 (FIG. 3A) of the motor vehicle body when the retainer member 11 is disposed in engagement with a mounting aperture 15 (FIG. 3A) formed through the reinforcement panel 3. The other arm 11*b* is so formed as to be resiliently deformable and also provided, on the circumferential surface thereof, with an engagement nail 14 which is adapted to be engaged with the inside surface of the reinforcement panel 3 when the retainer member 11 is disposed in engagement with the mounting aperture 15. The engagement nail 14 has its upper portion tapered so as to facilitate insertion of the deformable arm 11*b* in the mounting aperture 15 when the retainer member 11 is to be fitted therein. Obviously, the upper surface of the protrusion 13 and the lower surface of the engagement nail 14 are deviated from each other a distance substantially equal to the thickness of the reinforcement panel 3.

Figure 3A:
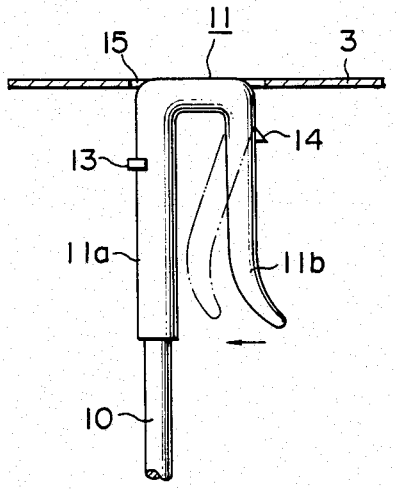
FIG. 3A, 3B and 3C are views showing how the structure shown in FIGS. 2A and 2B is mounted in place.
Figure 3B:
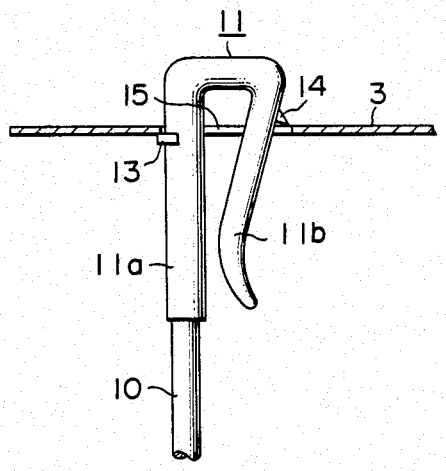
Figure 3C:
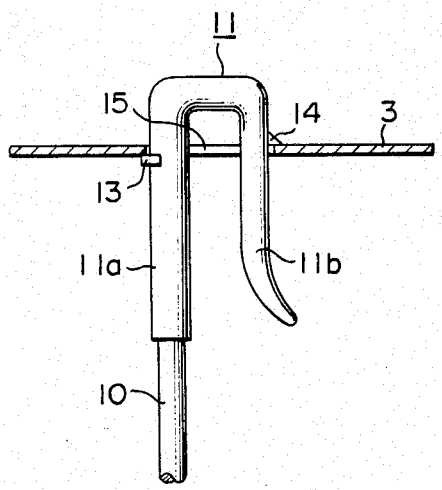
Figure 4:
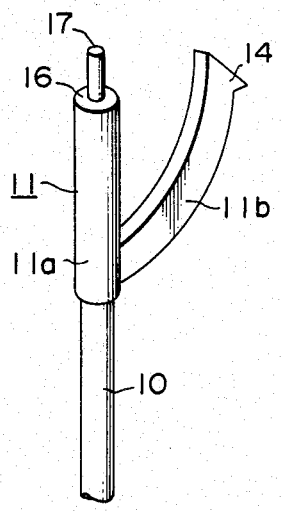
FIG. 4 is a view showing a modified form of retainer member according to a second embodiment of the present invention, as being attached to a support rod.

In operation, the arms 11*a* and 11*b* of the retainer member 11 secured to the support rod 10 are gripped by hand in such a manner that the arm 11*b* is forcibly deformed toward the arm 11*a* and then, with the arm 11*b* thus deformed, the retainer member 11 is inserted in the mounting aperture 15 until the protrusion 13 of the arm 11*a* is brought into contact with the outside margin of the mounting aperture 15 as shown in FIG. 3B. Subsequently, the gripping force being imparted to the arms 11*a* and 11*b* is released to permit the arm 11*b* to return to its original configuration, and thereupon, the engagement nail 14 of the arm 11*b* is brought into engagement with the inside margin of the mounting aperture 15. In this way, the retainer member 11 is securely fitted in the mounting aperture 15, so that the openable hood of the motor vehicle is supported at its open position by means of the support rod 10. As will be readily appreciated, the weight of the hood is borne by the protrusion 13 of the arm 11*a*, and removal of the retainer member 11 from the mounting aperture 15 is prevented by means of the engagement nail 14 of the arm 11*b*. Needless to say, the retainer member 11 can easily be removed from the mounting aperture 15 by performing the foregoing steps of operation reversely.

Figure 1B:
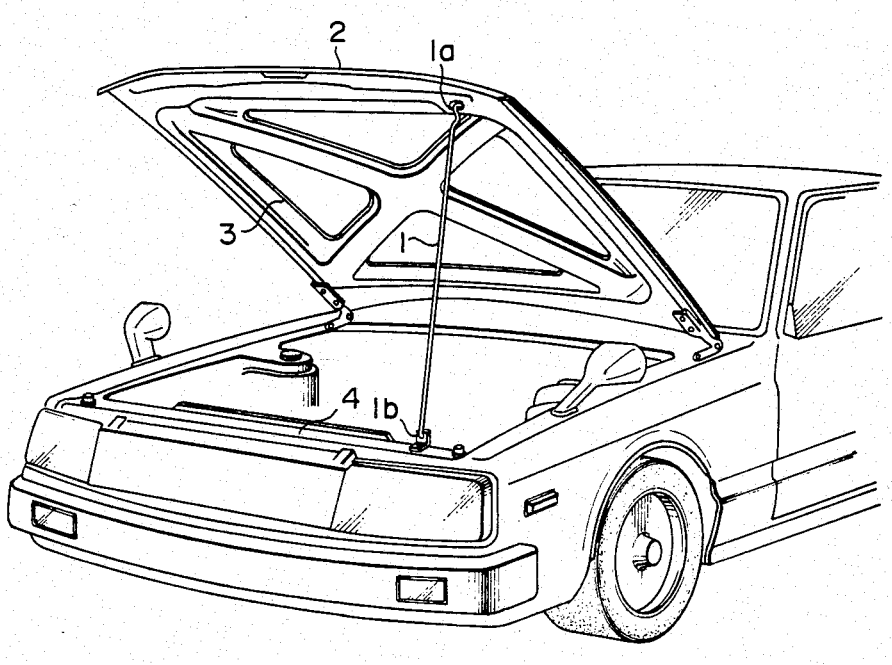
FIG. 1B PRIOR ART
FIG. 1B is a fragmentary perspective view showing a motor vehicle provided with a convention structure for removably mounting the support rod for supporting a hood of the motor vehicle at its open position.
Figure 2A:
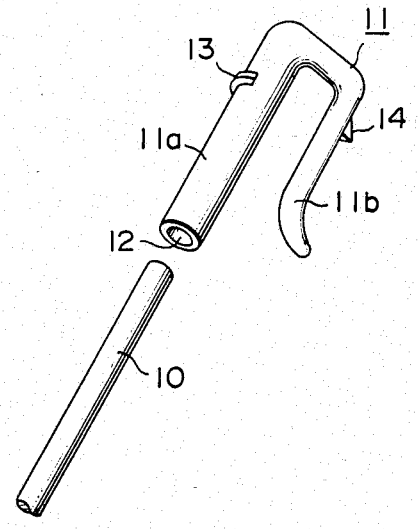
FIG. 2A is an exploded perspective view showing the structure according to a first embodiment of the present invention, including a support rod and a retainer member to be attached thereto.
Figure 2B:
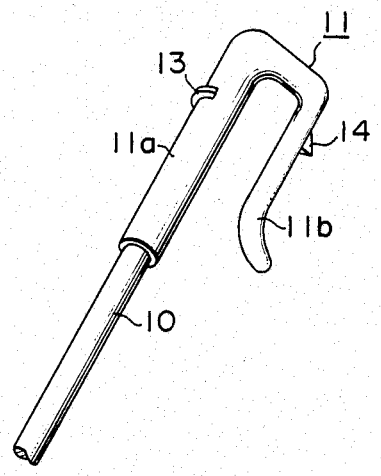
FIG. 2B is a perspective view showing the retainer member as attached to the support rod at one end thereof.
Figure 5A:
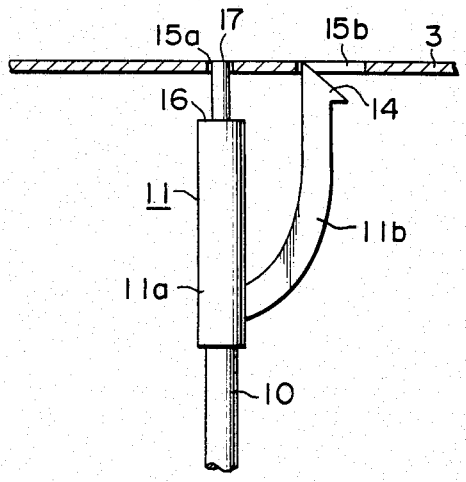
FIG. 5A, 5B and 5C are views, partly in section, showing how the structure shown in FIG. 4 is mounted in place.
Figure 5B:
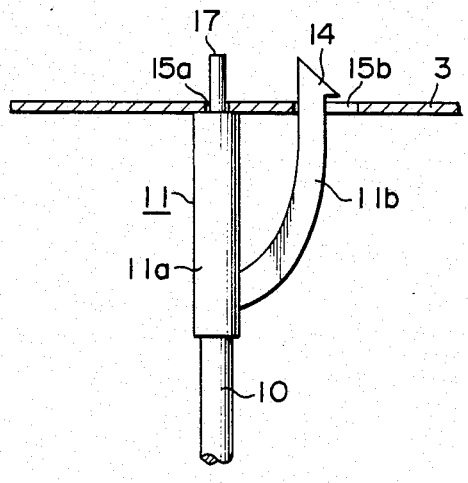
Figure 5C:
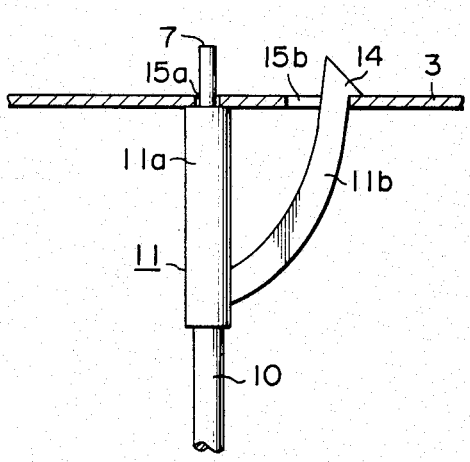

Referring next to FIGS. 4, 5A, 5B and 5C, there is shown the structure according to a second embodiment of the present invention which includes a retainer member 11 of a plastic material configured substantially in a U-shape comprising a pair of arms 11*a* and 11*b*. The arm 11*a* has its fore end face formed as an engagement surface 16 which is adapted to be engaged with the outside surface of the panel to support the latter. The arm 11*a* as also provided, on the engagement surface 16 thereof, with a co-axial shaft-like projection 17 which is adapted to be inserted through a mounting aperture 15*a* (FIG. 5A). The arm 11*b* is so formed as to be resiliently deformable and also provided with an engagement nail 14 which is adapted to be engaged with the inside margin of a mounting aperture 15*b* (FIG. 5A). The mounting apertures 15*a* and 15*b* may be formed in one or both of the panels 3 and 4 (FIG. 1B).

In operation, the projection 17 of the arm 11*a* is inserted in the mounting aperture 15*a*, while at the same time the arm 11*b* is gripped by hand to be resiliently deformed toward the arm 11*a*, and then, in such a state, the arm 11*b* is inserted in the mounting aperture 15*b*. When the engagement surface 16 of the arm 11*a* is disposed in contact with the outside margin of the mounting aperture 15*a*, the gripping force being imparted to the arm 11*b* is released so as to permit the arm 11*b* to return to its original configuration, so that the engagement nail 14 of the arm 11*b* is disposed in engagement with the inside margin of the mounting aperture 15*b*. In this way, the retainer member 11 is securely fitted in the mounting apertures; thus, the openable hood of the motor vehicle is supported at its open position by means of the support rod 10. As will be appreciated, the weight of the hood is borne by the engagement surface of the arm 11*a*, and removal of the retainer member from the mounting apertures is prevented by the engagement nail 14 of the arm 11*b*. As will also be appreciated, the retainer member 11 can easily be removed simply by performing the foregoing steps of operation reversely.

It goes without saying that the structure according to each of the aforementioned embodiments of the present invention can be applied to the both ends of the support rod. However, it is also possible that the present structure may be applied to one end of the support rod alone. In such a case, a retainer member, which is different in construction from that of the present invention and attached to the other end of the support rod, may be fitted in the corresponding mounting aperture. Alternatively, it is possible that such a retainer member may be fitted in engagement means mounted in the mounting aperture. Although in the foregoing embodiments, the support rod was formed of a plastic material, it is also possible that such rod may be made of metal as in the prior art.

As will be appreciated from the foregoing discussion, the structure according to the present invention is advantageous in that in the manufacture thereof, there are involved no steps for working any of the ends of the support rod in hook-like or crank-like configuration with high accuracy so that the number of manufacturing steps is greatly decreased and the manufacturing cost is reduced accordingly. As mentioned above, according to the present invention, a retainer member formed of a plastic material is provided at either or both of the ends of a support rod, and in operation, such a retainer member is fitted in and removed from a mounting aperture formed through a panel of the motor vehicle body. With such a structure, the operation of attaching and removing the support rod can far more easily be carried out than with the conventional arrangement wherein the hook-like and crank-like bent ends of a support rod are engaged directly with respective mounting apertures. Another important advantage of the present structure over the prior-art one is such that there is no tendency that the operation of attaching and removing the support rod leaves a scar in the panel surface to cause rust. In the case where the support rod is one formed of a plastic material as in the foregoing embodiments, there is no possibility that the support rod, when stored, is heated by the engine heat to such an extent that inconvenience is experienced in handling the same.

While the invention has been described and illustrated with respect to specific embodiments thereof, it is to be understood that the present invention is by no means limited thereto but covers all changes and modifications which will become possible within the scope of the appended claims.

What is claimed is:

1. A structure for removably mounting a support rod for supporting an openable closure such as engine hood of a motor vehicle at its open position, comprising:

a retainer means formed of a plastic material including a first arm, a second arm which is resiliently deformable toward said first arm, said retainer means being adapted to be attached to one end of the support rod;

said first arm being provided with a support means to support the weight of the closure member when the latter is supported at its open position by means of the support rod;

said second arm being adapted, when deformed, to be inserted in a mounting aperture formed in the motor vehicle, said second arm being provided with an engagement means adapted to be brought into engagement with the margin of said mounting aperture when said second arm returns from its deformed configuration to its original configuration, thereby securely mounting the support rod in place so that the closure member is therby supported at its open position.

2. A structure according to claim 1, wherein said retainer means is configured in an inverted U-shape; said support means comprises a protrusion provided on the outer circumferential surface of said first arm; and said engagement means comprises a nail-like member provided on the outer circumferential surface of said second arm.

3. A structure according to claim 2 wherein said nail-like member is tapered in such a direction as to facilitate the insertion of said second arm in said mounting aperture.

4. A structure according to claim 1, wherein said retainer means further comprises a co-axial shaft-like projection provided on the fore end face thereof, said projection being adapted to be inserted in a second mounting aperture formed in the motor vehicle; and said support means is constituted by said fore end face of said first arm.

* * * * *